United States Patent [19]

Sekikawa

[11] Patent Number: 4,830,050

[45] Date of Patent: May 16, 1989

[54] FLUID CONTROL VALVE

[75] Inventor: Keiji Sekikawa, Saitama, Japan

[73] Assignee: Kayaba Industry Co., Ltd., Japan

[21] Appl. No.: 256,718

[22] Filed: Oct. 12, 1988

[30] Foreign Application Priority Data

Oct. 14, 1987 [JP] Japan ..... 62-157279[U]

[51] Int. Cl.[4] ..... F15B 13/042

[52] U.S. Cl. ..... 137/599.2; 251/33

[58] Field of Search ..... 137/599.2; 251/33

[56] References Cited

U.S. PATENT DOCUMENTS 4,355,565 10/1982 Bianchetta ..... 137/599.2 X 4,466,336 8/1984 Broome et al. ..... 137/599 .2 X 4,579,044 4/1986 Johnson ..... 137/599.2 X

*Primary Examiner*—John Rivell

*Attorney, Agent, or Firm*—Steinberg & Raskin

[57] ABSTRACT

A fluid control valve so constructed that when a spool arranged in a valve housing is at its neutral position, a neutral passage communicates with a tank passage, whereas when the spool is changed over, communication therebetween is blocked, to thereby supply fluid in the neutral passage to an actuator. The spool is formed with a first oil communication passage communicating with a parallel passage and a second oil communication passage communicating with the actuator. Also, the spool is provided therein with a sub-spool, which is provided on an outer periphery thereof with a land and an annular groove for selectively carrying out communication between the first oil communication passage and the second oil communication passage depending on its moved position. The sub-spool has one end facing a pilot passage, which communicates at one end with the parallel passage and at the other end thereof through an orifice with an on-off valve. Opening of the on-off valve causes fluid to pass through the orifice, so that pressure loss of the fluid occurs across the orifice to lead to an increase in pressure on an upstream side thereof, resulting in the sub-spool being changed over.

1 Claim, 2 Drawing Sheets

FLUID CONTROL VALVE

BACKGROUND OF THE INVENTION

This invention relates to a fluid control valve, and more particularly to a fluid control valve suitable for use for a construction equipment.

A valve mechanism or apparatus which has been conventionally used for controlling an arm cylinder and a boom cylinder of a construction equipment is generally constructed in such a manner as shown in FIG. 1. More particularly, the conventional valve mechanism or apparatus includes a neutral passage 1, to which a control valve 2 for a boom cylinder and a control valve 3 for controlling an arm cylinder are connected. When the control valve 2 for controlling the boom cylinder is changed over to supply pressure oil to the boom cylinder, it closes the neutral passage 1.

The control valve 3 for controlling the arm cylinder includes a spool 4 having one end facing a spring chamber 5 and the other end facing a pilot chamber 6. When any pressure is not applied to the pilot chamber 6, the spool 4 is kept at a position shown in FIG. 1 by means of a spring 7 arranged in the spring chamber 5, to thereby communicate the neutral passage 1 with a tank 8. An actuator passage 9 communicating with the arm cylinder constantly communicates with the neutral passage 1 irrespective of a moved position of the spool 4. Application of a pilot pressure to the pilot chamber 6 in this state causes the spring 4 to be moved against the spring 7, resulting in communication between the neutral passage 1 and the tank 8 being blocked. The actuator passage 9 is provided with a load check valve 10.

Reference numeral 11 designates a change-over valve provided separate from the control valves 2 and 3, which serves to operate a parallel passage 12. The change-over valve 11 includes a spool 13 which is so arranged that one end thereof faces a spring chamber 14 and the other end thereof faces a pilot chamber 15. The spring chamber 14 is provided therein with a spring 16, which acts to cause the parallel passage 12 to communicate through a first oil communication hole 17, a communication hole 18, a second oil communication hole 19 and a load check valve 20 to the actuator passage 9 when the spool 13 is at a normal position shown in FIG. 1.

The spring chamber 14 is arranged so as to communicate through an orifice 21 to the parallel passage 12, and the orifice 21 is connected on a downstream side thereof through an on-off valve 22 to a tank 23. Also, the pilot chamber 15 communicates with the parallel passage 12.

In the conventional mechanism or apparatus constructed as described above, when it is not desired to actuate the boom cylinder, the control valve 2 is kept at its neutral position, so that the neutral passage 1 is kept open. This results in fluid supplied to the neutral passage 1 flowing to the control valve 3. At this time, when the control valve 3 is kept at a normal position shown in Fig. 1, the fluid flowing into the control valve 3 is returned to the tank 8. Accordingly, when a pilot pressure is applied to the pilot chamber 6 of the control valve 3, communication between the neutral passage 1 and the tank 8 is blocked to cause fluid in the neutral passage 1 to be supplied through the load check valve 10 to the arm cylinder.

When the control valve 2 is changed over to any position other than its neutral position in order to simultaneously actuate the boom cylinder while pressure fluid is supplied to the arm cylinder, the neutral passage 1 is closed to block supply of fluid to the control valve 3, so that supply of pressure fluid to the arm cylinder is blocked to lead to interruption of the arm cylinder. However, such interruption of actuation of the arm cylinder every time when the boom cylinder is moved prevents smooth work. In order to eliminate such a problem, the apparatus is adapted to supply fluid in the parallel passage 12 to the actuator passage 9. More particularly, keeping of the on-off valve 2 at its closed position shown in FIG. 1 causes the spool 13 of the change-over valve 11 to be also held at a normal position shown in FIG. 1, so that pressure fluid in the parallel passage 12 may be supplied through the first oil communication hole 17, communication hole 18, second oil communication hole 19 and load check valve 20 to the actuator passage 9. This results in supply of fluid in the parallel passage 12 to the arm cylinder being ensured even when the neutral passage 1 is closed.

When it is not needed to supply fluid in the parallel passage 12 to the arm cylinder, the on-off valve 22 is changed over to its open position. Such changing-over of the on-off valve 22 to the open position causes pressure loss in fluid passed through the orifice 21 to occur across the orifice, resulting in the balance of pressure between the spring 14 and the pilot chamber 15 to be lost. This causes the spool 13 to be moved against the spring 16, to thereby close the second oil communication hole 19.

Thus, the conventional control valve apparatus requires two spools or the spool for the control valve 3 and the spool for the change-over valve 11 separately, accordingly, it is required to form two spool holes in the valve, resulting in manufacturing of the apparatus being highly troublesome and its structure being significantly complicated. Also, this leads to large-sizing of the apparatus.

SUMMARY OF THE INVENTION

The present invention has been made in view of the foregoing disadvantage of the prior art.

Accordingly, it is an object of the present invention to provide a fluid control valve which is capable of facilitating its manufacturing.

It is another object of the present invention to provide a fluid control valve which is capable of simplifying its structure.

It is a further object of the present invention to provide a fluid control valve which is capable of being substantially small-sized.

It is a further object of the present invention to provide a fluid control valve which is constructed in such a manner that the conventional control valve and change-over valve are integrally formed.

In accordance with the present invention, a fluid control valve is provided. The fluid control valve is so constructed that when a spool arranged in a valve housing is at its neutral position, a neutral passage communicates with a tank passage; and when the spool is changed over, communication between the neutral passage and the tank passage is blocked, to thereby supply fluid in the neutral passage to an actuator.

For this purpose, in the fluid control valve, the spool is formed with a first oil communication passage communicating with the parallel passage and a second oil communication passage communicating with the actuator. Also, the spool is provided therein with a sub-spool, which is provided on an outer periphery thereof with a land and an annular groove for selectively blocking communication between the first oil communication passage and the second oil communication passage depending on its moved position. The sub-spool is also formed therein with a pilot passage extending in an axial direction thereof. The pilot passage is connected at one end thereof to the parallel passage and at the other end thereof through an orifice to an on-off valve. The sub-spool is changed over due to pressure loss of fluid passed through the orifice.

Such construction of the fluid control valve of the present invention permits the neutral passage to be closed due to movement of the spool. Opening of the on-off valve causes the sub-spool to be moved to block communication of the parallel passage.

Thus, the control valve of the present invention requires only one spool hole because the sub-spool is arranged in the spool. This results in the valve being highly simplified in manufacturing and substantially small-sized.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENT

Figure 1:
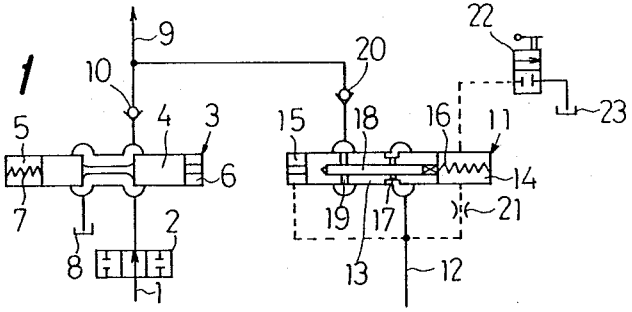
FIG. 1 PRIOR ART
FIG. 1 is a circuit diagram showing a conventional valve mechanism or apparatus for controlling an arm cylinder and a boom cylinder of a construction equipment.
Figure 2:
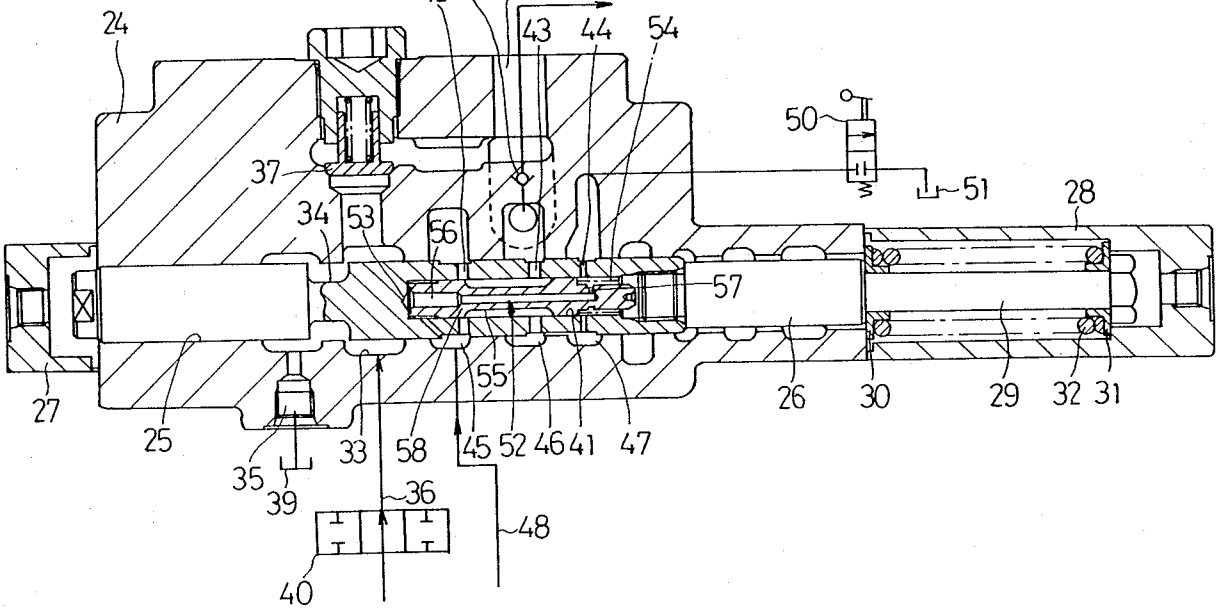
FIGS. 2 and 3 each are a vertical sectional view showing an embodiment of a fluid control valve according to the present invention.
Figure 3:
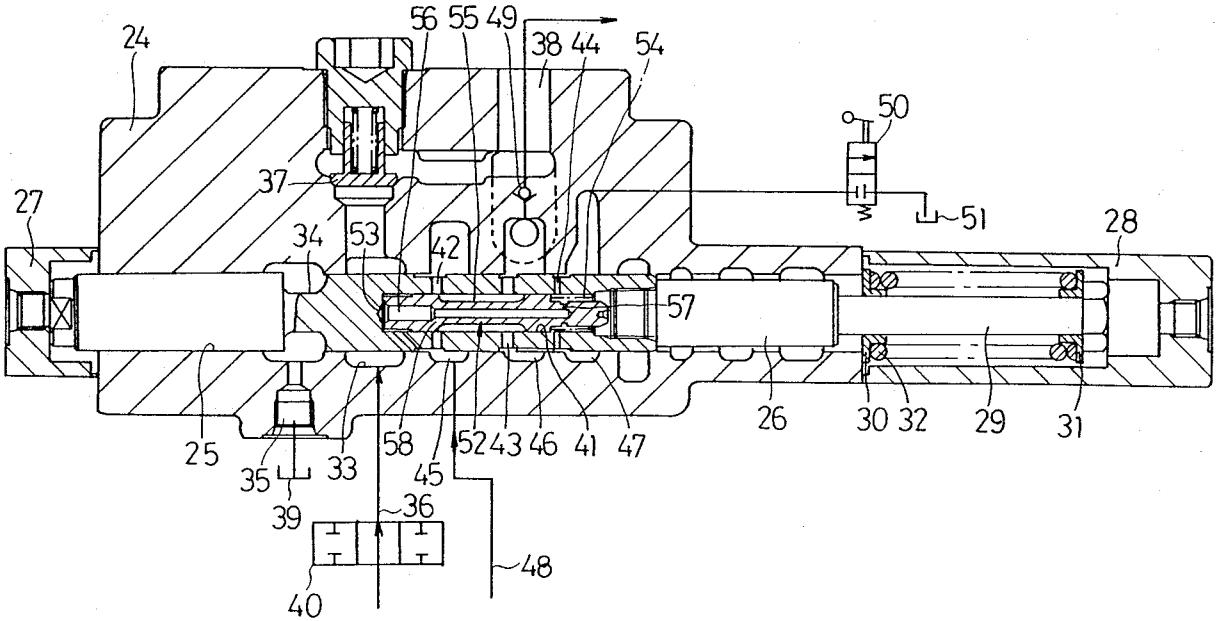

FIGS. 2 and 3 shows an embodiment of a fluid control valve according to the present invention.

A fluid control valve of the illustrated embodiment includes a valve housing 24 which is formed therein with a through-hole 25 which serves as a spool hole and a spool 26 slidably received in the spool hole 25.

The single spool hole 25 is closed at one end thereof with a cap 27 and provided at the other end thereof with a spring case 28. Into the spring case 28 is projected a bolt 29 fixed on one end of the spool 26, and the bolt 29 has spring bearings 30 and 31 provided thereon in a manner to be slidable thereon. Between the so-arranged spring bearings 30 and 31 is interposed a centering spring 32, which serves to keep the spool 26 at a neutral position shown in FIG. 2 unless any pressure is applied to an interior of the spring case 28.

The single spool hole 25 is formed on an inner periphery thereof with a first annular recess 33, which is adapted to communicate through an annular groove 34 formed on the spool 26 with a tank port 35 formed in the valve housing 24 when the spool 26 is at the neutral position. The first annular recess 33 constantly communicates with a neutral passage 36 connected to the valve housing 24 and also communicates through a load check valve 37 to a cylinder port 38. When the so-arranged spool 26 is at the neutral position, fluid supplied through the neutral passage 36 is returned through a tank passage formed in the valve housing 34 including the first annular recess 33 and annular groove 34 to a tank 39.

Reference numeral 40 designates a control valve for controlling a boom cylinder. The control valve is adapted to close the neutral passage 36 when it is changed over, as in the prior art described above.

The spool 26 is also formed therein with a sub-spool hole 41, which communicates with a first oil communication hole 42, a second communication hole 43 and a pilot hole 44 respectively formed at the spool 26. The holes 42 to 44 are adapted to constantly communicate with second to fourth annular recesses 45 to 47 formed on an inner periphery of the spool hole 25 irrespective of a position of the spool 26 moved, respectively. Further, the second annular recess 45 communicates with a parallel passage 48 connected to the valve housing 24 and the third annular recess 46 communicates through a load check valve 49 with the cylinder port 38. The fourth annular recess 47 is connected through an on-off valve 50 to a tank 51.

In the sub-spool hole 41 is slidably fitted a subspool 52, which has one end facing a pilot chamber 53 constantly communicating with the second annular recess 45. An opposite side of the sub-spool 52 is applied thereto elastic force of a spring 54. Further, the sub-spool 52 is formed on an outer periphery thereof with an annular groove 55.

Thus, the sub-spool 52 is normally kept at a normal position shown in FIG. 2. The first oil communication hole 42 and second oil communication hole 43 communicate with each other through the annular groove 55 while the sub-spool 52 is kept at the normal position. The sub-spool 52 is also formed therein with a pilot chamber 56 for communicating the pilot chamber 53 with the pilot hole 44 therethrough. Between the pilot chamber 53 and the pilot hole 44 is arranged an orifice 57.

In the fluid control valve of the illustrated embodiment constructed as described above, when the spool 26 is kept at the neutral position shown in FIG. 2, fluid in the neutral passage 36 is returned to the tank 39 as described above, so that supply of the fluid to the cylinder port 38 is prevented. When the spool 26 is moved in a lefthand direction in FIG. 2 from the neutral position to a position shown in FIG. 3, the annular groove 34 is separated from the first annular recess 33 to block communication between the neutral passage 36 and the tank 39.

Accordingly, fluid supplied from the neutral passage 36 opens the load check valve 37, resulting in being supplied through the cylinder port 38 to the arm cylinder.

At this time, when the on-off valve 50 is kept at a closed position shown in FIGS. 2 and 3, the sub-spool 52 is held at a position shown in FIGS. 2 and 3, so that fluid from the parallel passage 48 may be supplied through the second annular recess 45, first oil communication passage 42, annular groove 55, second oil communication hole 43, third annular recess 46, load check valve 49 and cylinder port 38 to the arm cylinder. Thus, it will be noted that supply of fluid to the arm cylinder is ensured even when the boom cylinder is actuated.

Also, when the on-off valve 50 is changed over to its open position, pressure loss of fluid passed through the orifice 57 occurs across the orifice 57 to generate a pressure, so that the pressure is applied to the pilot chamber 53 to cause the sub-spool 52 to be moved against the spring 54. Such movement of the sub-spool 52 causes a land 58 provided on the sub-spool 52 in adjacent to the annular groove 55 to close the first oil communication hole 42, to thereby prevent fluid in the parallel, passage 48 from being supplied to the cylinder port 38.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed:

1. A fluid control valve comprising:

a valve housing;

a spool arranged in said valve housing and connected to a neutral passage and a tank;

said spool being formed with a first oil communication hole communicating with a parallel passage and a second oil communication hole communicating with an actuator;

a sub-spool arranged in said spool;

said sub-spool being formed on an outer periphery thereof with a land and an annular groove for selectively carrying out communication between said first oil communication hole and said second oil communication hole depending on a moved position of said sub-spool;

said sub-spool being formed therein with a pilot passage extending in an axial direction thereof;

said pilot passage communicating at one end thereof with said parallel passage and at the other end thereof through an orifice provided in said valve housing with an on-off valve;

said sub-spool being changed over due to a pressure differential across said orifice;

whereby said spool communicates a neutral passage with a tank therethrough when it is at its neutral position and interrupts communication between said neutral passage and said tank when it is changed over, to thereby cause fluid in said neutral passage to be supplied to an actuator.

* * * * *